United States Patent [19]

Deforeit

[11] 4,217,802

[45] Aug. 19, 1980

[54] POLYPHONIC DIGITAL SYNTHESIZER

[76] Inventor: Christian J. Deforeit, 202, rue des Joncs Marins, 91621 La Ville de Bois, France

[21] Appl. No.: 918,576

[22] Filed: Jun. 23, 1978

[30] Foreign Application Priority Data

Jul. 1, 1977 [FR] France ..... 77 20245

[51] Int. Cl.[2] ..... G10H 1/02

[52] U.S. Cl. ..... 84/1,01; 364/718

[58] Field of Search ..... 84/1.01, 1.03; 364/718

[56] References Cited

U.S. PATENT DOCUMENTS

| | | | |
|---|---|---|---|
| 3,878,750 | 4/1975 | Kapps | 84/1.03 |
| 3,882,751 | 5/1975 | Tomisawa et al. | 84/1.01 |
| 3,908,504 | 9/1975 | Deutsch | 84/1.19 |
| 4,147,083 | 4/1979 | Woron et al. | 84/1.03 |

OTHER PUBLICATIONS

H. Schmidt, Electronic Analog/Digital Conversion, 1970, pp. 206–207, 212–213.

*Primary Examiner*—Gene Z. Rubinson

*Assistant Examiner*—Forester W. Isen

*Attorney, Agent, or Firm*—Oblon, Fisher, Spivak, McClelland & Maier

[57] ABSTRACT

A polyphonic digital synthesizer which will generate a plurality of periodic signals in real time with independent control of amplitudes. A set of digital memories are at least equal in number to the periodic signals to be produced, the address of each memory determining the frequency of a signal and the content of said memory determining at least the amplitude of said signal. Digital to analog conversion means produce positive or negative analog voltage or current steps whose amplitude is proportional to a data item read in a memory and in response to control signals. These reading and transfer of the data from the memories to the conversion means and conversion control signals are provided in accordance with the transitions of pulsed signals whose repetition frequencies are distributed over a predetermined musical range. Complex output signals can be obtained by writing data in the memories according to an additive synthesis method.

14 Claims, 7 Drawing Figures

POLYPHONIC DIGITAL SYNTHESIZER

BACKGROUND OF THE INVENTION

The present invention relates generally to musical instruments and more particularly to a polyphonic periodic-signal synthesizer and to polyphonic electronic musical instruments comprising one or more such synthesizers.

There exist constantly increasing numbers of musical instruments in which electronic techniques are utilised to produce musical signals. The most traditional of these is the monophonic or polyphonic electronic organ, which utilises either analog techniques or digital techniques, or more often a mixture of both. Usually, in polyphonic instruments, a set of oscillators and dividers generate a large number of periodic signals having specific spectral characteristics. A set of keys, buttons and pedals actuated by the user of the instrument select one or more periodic signals and transmit them to filtering circuits intended to modify their spectral characteristics as a function of the positions of stop control members and sometimes as a function of time. The richness of the sounds produced depends upon the complexity of the circuits and the polyphonic character of the instrument involves a multiplication of the circuits, controls and wiring, and hence of the cost.

The use of digital techniques makes it possible to reduce the complexity of the wiring at the level of the keyboards and of the controls, for example by using a method of sequentially scanning the various keys, buttons, levers and pedals. However, there are always material and direct coupling means between these control means, the signal-generating circuits and the filtering circuits, so that the creation of a novel instrument, or the modification of the characteristics of an existing instrument, involve a substantially complete new study of the circuits and considerable work on the material plane.

SUMMARY OF THE INVENTION

One object of the present invention is to obviate these disadvantages by the use of a polyphonic synthesizer module independent of the means of controlling the instrument, and independent of the actual nature of the instrument (piano, organ, accordion, etc.).

Another object of the invention is to provide a synthesizer module, of which the control means are not directly accessible in the usual manner by means of keys, pedals, buttons and other means, but rather in a virtual manner, utilising logic means rather than material means.

Finally, another object of the invention is to construct a polyphonic synthesizer of which almost all the components can be disposed in one or two integrated circuit chips for the purpose of fabrication on a large scale, with resultant low cost, low consumption and high rapidity of design and application of a musical instrument.

In accordance with one feature of the invention, the synthesizer comprises means for the production of a set of pulsed signals, of which the repetition frequencies are distributed over a predetermined musical range; a set of digital memories at least equal in number to the periodic signals to be simultaneously produced, each memory determining the frequency of a periodic signal by its address in a memory space and at least the amplitude of the corresponding signal to be produced, by its content;

digital-analog conversion means for producing positive or negative analog voltage or current steps whose amplitude is relative to one digital data item applied to the conversion means; and conversion control means for producing, in response to the pulsed signals, control signals for the reading and the transfer of the data from the memories to the conversion means and control signals for the conversion means.

Thus, the present invention takes the form of a module capable of generating by itself a large number of periodic signals (sinusoidal, triangular, rectangular, etc.) in polyphonic manner, in accordance with digital data written in corresponding memory elements. The module takes the form of a large number of signal generating circuits which simultaneously produce all these signals, the amplitude of each of the signals being proportional to an item of digital data written in a corresponding memory element. Of course, each memory element may contain in addition to an item of amplitude information, an item of phase information, an item of frequency information; and so on, which are automatically exploited by the module, for example in order to shift the phase, the frequency, and so on, of the corresponding signal.

An essential advantage of such a synthesizer module is that it is polyphonic by nature and that it can therefore simultaneously produce a very large number of signals (this number may be greater than 100) without thereby increasing the complexity of the module.

Another advantage of the module results from the control means which serve to control the production of the signals. A periodic signal of given frequency and amplitude is obtained by introducing a digital item of data relative to the amplitude in a memory element whose location, i.e. its address in the memory space, or the set of memories, is relative to the frequency (at least).

Consequently, the memory elements may be charged by a large number of means outside the synthesizer module. More particularly, an advantageous means for introducing items of amplitude data into the memory elements consists in using a microcomputer, with respect to which the synthesizer module behaves as a simple peripheral unit. The microprocessor circuits at present available on the market can readily be given functions which have hitherto been performed by material techniques incorporated in the existing instruments. More particularly, the microprocessor explores the keyboards, pedals, stop buttons, preselection buttons and so on, and controls the introduction of digital data into the memories of the module in accordance with a preset programme.

Many sounds can be obtained by harmonic synthesis, the synthesis being effected by programme, and many special effects can be created by programme. Such programmes are not unalterable as are material means, so that it is possible to obtain a transformation or simply an evolution of the characteristics of the instrument without the necessity for profound transformations on the material plane. It is thus possible to create a range of products utilising the same equipment.

Thus, the change-over from one or more keyboards accessible to the musician to the set of memories of the module takes place by means of information processing operations similar to those which are found in computer-controlled applications.

For the sake of simplicity and for a better understanding of the invention, the term "virtual keyboard" will be used in the following description to designate the set of memories whose content and location represent respectively the amplitude and the frequency of one or more periodic signals. Of course, other items of information, in addition to the amplitude, can be stored in the memories of the virtual keyboard. In contradistinction thereto, the controls accessible to the musician will be referred to by the expression "real keyboard."

There may correspond to a key or a pedal of a real keyboard the placing in storage of items of information in a number of memory elements of the virtual keyboard, and the actuation of a key of real keyboard must result in the production of a generally complex musical signal. Unless the synthesizer module directly produces such complex signals, the signal which the module must supply is the sum of a number of simple signals, such as sinusoidal signals. This is due to the fact that any complex signal may be broken down into a sum of sinusoidal signals (Fourier series), one being the fundamental signal and the others the harmonics.

Of course, each of the simple signals constituting a complex signal has its own phase and its amplitude-time function, which may be independent of that of the other signals. This amounts to controlling the storage of data in a number of elements of the virtual keyboard, the value of which varies in time in accordance with a preset programme, for each actuation of the real keyboards. When a number of notes of one or more real keyboards are simultaneously played, the value written into a memory of the virtual keyboard may be the sum of a number of values, which only involves additions.

BRIEF DESCRIPTION OF THE DRAWINGS

Further features and advantages of the present invention will become apparent from the following description, which is illustrated by the following figures, in which.

DESCRIPTION OF THE PREFERRED EMBODIMENT

Figure 1:
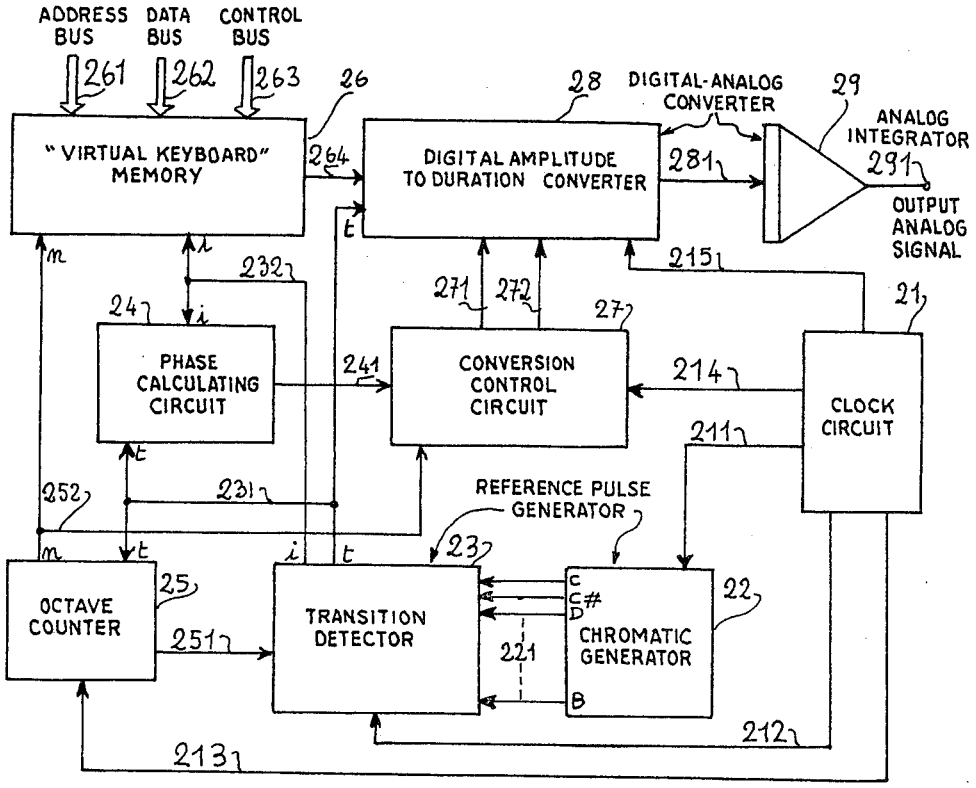
FIG. 1 is a basic diagram of the synthesizer according to the invention.

FIG. 1 shows a basic diagram of the synthesizer according to the invention.

It comprises 4 essential sub-assemblies:

a so-called "virtual keyboard" memory 26, of which the memory elements are at least equal in number to the periodic signals which it is desirable to produce.

a digital-analog converter 28–29 intended to convert a stored item of data into a voltage or current step.

A reference pulse generator 22–23 producing a number of series of pulses, of which the repetition frequencies are distributed in accordance with the various notes of a preset range, that is to say, for example, in accordance with the 12 semitones of an octave.

Finally, means for controlling the reading of the "virtual keyboard" memory and the conversion 25–24–27, driven by the pulses of the reference pulse generator in accordance with a preset programme.

These 4 sub-assemblies may, of course, have a more or less complex structure. Constructional details of each of them are given in the following description. A clock 21 controls and synchronises the assembly. Clock signals are transmitted to the conversion means 28 through the link 215, to the conversion control means 25 and 27 through the links 213 and 214, and to the reference pulse generator through the links 211 and 212.

The "virtual keyboard" memory 26 comprises a predetermined number of memory locations, which can be addressed in the conventional manner by an address bus as in a computer. The address of a memory location corresponds to the frequency of a periodic signal which will be supplied by the synthesizer. If the distribution of the frequencies is chosen like that of the 12 semitones of an octave, the address for the reading or writing in the memory locations of the virtual keyboard is formed of a set of two numbers: a (note number i comprised between 0 and 11) and an octave number n. Each location of the virtual keyboard is therefore designated by a particular couple (i,n). The virtual keyboard may be addressed in different ways: by an address bus 261 which connects the synthesizer to the remainder of the instrument in regard to its positioning in the total memory space of the latter, and by internal addressing controls 232 and 252, which will hereinafter be explained. The addressing of the virtual keyboard from two different sources poses no problem to the person skilled in the art. For example, it is sufficient to use a multiplexor circuit on the addresses at the input of the virtual keyboard and to reserve an interval of time for the addresses coming from the bus 261 and another interval of time for the addresses coming from the connections 232 and 252.

The virtual keyboard memory receives and also delivers data. It receives data coming from the instrument by way of a data bus 262 and a write signal through a control bus 263.

The links 261, 262 and 263 may, of course, be established by means of an interface circuit which is regarded as included in the virtual keyboard memory, so as to present the synthesizer in compatible manner with a microprocessor bus, for example. Such interface circuits are marketed by many constructors, for example under the designation "8255."

By means of the links 261, 262 and 263, it is therefore possible to write data at any addresses of the virtual keyboard. These data are relative to the amplitude of the voltage or current steps to be supplied by the converter (28–29).

A data Δ A read in a memory location of the virtual keyboard is available along a link 264 proceeding to the converter 28.

A chromatic generator circuit 22 supplies 12 or 13 rectangular signals situated in the highest octave that can be produced by the synthesizer. The 12 or 13 signals (C, C♭, D, . . . B) of the chromatic generator 22 are applied to a transition detector circuit 23. There is meant by "transition" any change from the high level to the low level, or vice versa, of a rectangular signal of the chromatic generator. The detector circuit 23 detects the transitions of the 12 or 13 rectangular signals and accordingly supplies at each transition two digital signals, one at 231 which is a control pulse t serving to start a counting and conversion cycle, and other at 232, which is the number i of the corresponding signal (note of the chromatic generator). The detector 23 thereafter remains blocked as long as an end-of-cycle pulse is not returned to it through a link 251. The clock 21 supplies control signals to the chromatic generator 22 and to the transition detector 23 by way of the links 211 and 212 respectively.

The chromatic generator 22 can be constructed with the aid of 12 or 13 independent oscillators, or better still from a commercially obtainable circuit driven by the clock 21, such as the circuit MK 50240 manufactured by the company MOSTEK for example.

The transition detector 23 can be constructed in various manners. It may comprise, for example, 12 or 13 bistable circuits receiving respectively the rectangular signals of the chromatic generator 22, each bistable circuit changing from the state "0" to the state "1" at each transition of the corresponding rectangular signal. A priority encoder followed by a decoder detects the first bistable circuit to change to the state "1," supplies the control signal t at 231 and the number i at 232 and effects the return to "0" of the bistable circuit on reception of the end-of-cycle pulse through 251. The transition detector may also comprise a divide-by-twelve counter and a comparator which cyclically explore at great speed the outputs of the generator 22 and compare these outputs with a preceding state stored in a memory or a shift register.

The number i of the signal or note (in the highest octave) of which a transition has been detected serves for the addressing of the virtual keyboard memory 26 on the one hand and of one or more memories in the reading and conversion control means (notable 24) on the other hand.

The beginning-of-cycle pulse t (231) which indicates that a transition has taken place on the note i serves to actuate the reading and conversion control means (25,24,27).

In the first place, it actuates a phase sample calculating circuit 24 and in the second place it starts a counter 25.

The phase sample calculating circuit 24 receives the number i (link 232) of the note of which a transition has been detected and the beginning-of-cycle pulse t (link 231). It then supplies, along the link 241, a value increased by one unit in relation to the value before reception of the pulse t, for the same value of i. In order words, at the instant under consideration, the value at 241 represents the instantaneous phase $\omega$ it of the note i, in the highest octave that can be produced by the synthesizer.

The phases of the notes i situated in the upper octaves are obtained with the aid of an octave counter 25, the number of positions of which is equal to the number of octaves that can be supplied by the synthesizer. The counter 25 is brought into the start position by the pulse t (link 231).

It then regularly counts up to a position of arrival which, for example, causes it to stop and produces an end-of-cycle pulse (link 251) addressed to the transition detector 23. This end-of-cycle pulse authorises the transition detector 23 to supply a new pulse t and a new note number i.

The value n of the counter 25 is available at a link 252. It is supplied to the memory 26 for addressing (with the corresponding value i) a memory location, and to the actual conversion control circuit 27.

The control circuit 27 receives the octave number n (link 252) and the phase $\omega$ it (link 241) of the low octave. It deduces therefrom two control signals (links 272 and 271) which are binary signals (active in the high state or in the low state).

The signal along the link 271 controls the charging, that is to say, the taking into account of the value $\Delta$ A supplied by the virtual keyboard memory 26 and corresponding amplitude variation (increase or decrease) of the output analog signal which is available at a terminal 291.

The signal along the link 272 indicates whether this modification is an increase or a decrease.

The control circuit 27 can be very simply constructed with the aid of a transcoding circuit or a programmed read-only memory which receives as address all the signals supplied by the link 241 (phase of the low octave) and 252 (n octave number) and supplies two bits of data, the first bit (271) being a control bit and the second (272) being a sign bit.

The digital-analog conversion means (28–29) are intended to produce a modification of the level of the output analog signal (link 291) only if the link 272 indicates the sign of the change and 264 the value of the change.

The converter comprises in fact two distinct parts. The first part 28 is a converter for changing a digital data unit into a bipolar signal, the duration of one of the states of which is proportional to the data item, and the second an analog integrator 29 which converts the duration of the state of the bipolar signal into a voltage (or current) variation. For the sake of simplicity, it will be assumed that the output variable is a voltage.

The output signal 281 of the digital-duration converter is therefore a signal having three states: a high state during which the output voltage of the integrator increases, a low state during which the output voltage decreases, and and intermediate state at very high impedance, during which the output voltage of the integrator remains constant. Many constructions of the converter device are possible, one example being given in the following and illustrated by FIG. 4.

The operation of the synthesizer will be more readily understood if it is first assumed that it produces signals only for a single note (a single value of i), the other notes thereafter being generated in the same way.

The phase calculating circuit 24 is a counter incremented at the rhythm of the pulses t(i) supplied by the assembly comprising the chromatic generator 22 and the transition detector 23. The phase counter is, for example, an 8-bit counter, that is to say, a counter having 256 positions. There correspond to each position of the counter, by way of the control circuit 27, two control signals, one for controlling a modification of the output voltage of the synthesizer, proportional to the value $\Delta$ A read from the memory 26, and the other for controlling its sign (voltage increase or decrease).

If, for example, there correspond for all positions of the counter an active change control and a constant sign control, this means that the output voltage will undergo at each pulse t a constant change $\Delta$ A. The output signal will then be a linear ramp (substantially in staircase form) which continuously decreases. This case cannot be envisaged, because the output circuits would rapidly reach saturation.

To give another example, if for the 128 first positions of the phase counter there correspond an active change control and a positive sign control and if for the 128 last positions there correspond an active change control and a negative sign control, there will be a rising linear ramp during the first 128 pulses t and a descending linear ramp during the last 128. The output signal is then a triangular signal. This amounts to using the last bit of the phase counter as sign control to be applied to the converter.

Figure 5:
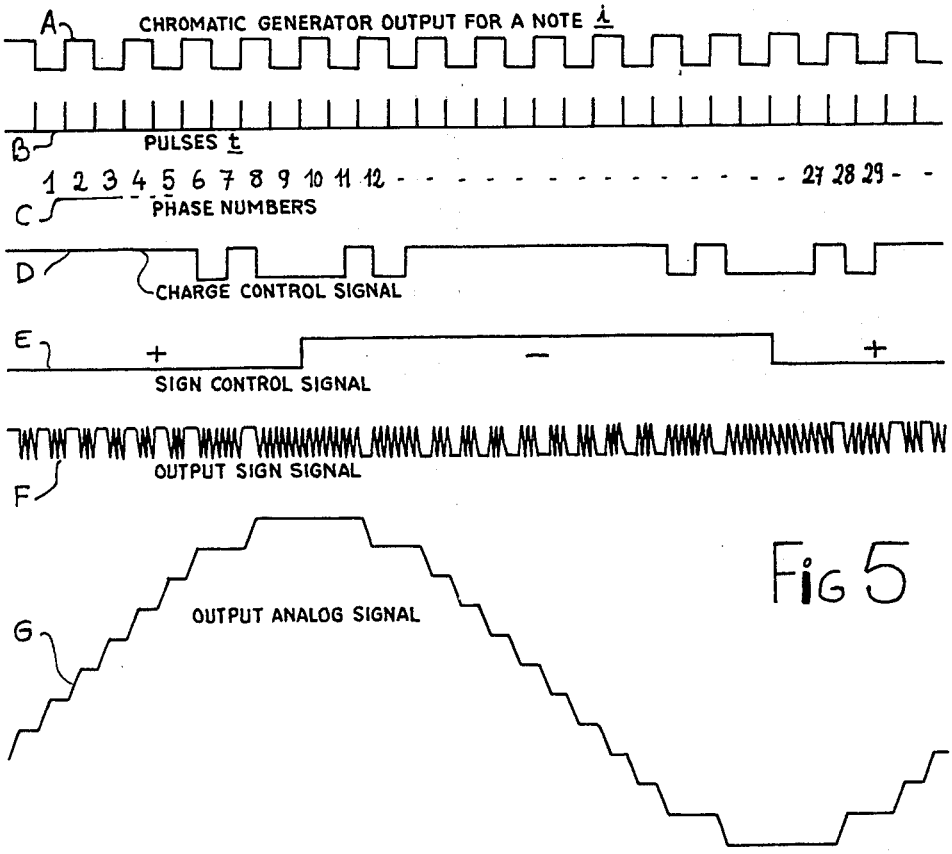
FIG. 5 is an illustration of the signals of the converter.

It is possible with such a synthesizer to produce numerous forms of periodic signals. FIG. 5 shows by way of example the formation of a sinusoidal signal.

In all cases, the last bit is the sign control and the first bits of the phase counter 24 serve to control a wave form. Thus, for producing the notes i of the upper octaves, it is sufficient to effect a shift to the left of the content of the phase counter. If the counter is of the 8-bit type, the 8th bit being the sign control of the note i in the lowest octave (n=0), the 7th bit is then the sign control of the octave n=1, the 6th bit for the octave n=2, and so on up to the 8th octave.

The value of n which serves to shift the phase value by one bit towards the left each time n increases by one unit, serves at the same time as address with the value of i, for controlling the reading of a value Δ A in the virtual keyboard.

When a transition t is detected for a note i, conversions are therefore successively effected for the values of Δ A corresponding to n=0, n=1, . . ., etc. An end-of-cycle pulse is then sent through 251 to the transition detector 23 and similar operations take place for another value of i.

All the operations are carried out sufficiently rapidly to enable the synthesizer to produce all the possible sounds in polyphonic manner.

In the case of FIG. 1, there is apparent a minor disadvantage which is due to the fact that the signal in the low octave is defined by 256 positions of the counter, while the signal in the octave n=1 is defined only by 128 positions. The peak-to-peak amplitude of the signal in the octave n=0 is therefore double that of the octave n=1, four times that of the octave n=3, and so on. This disadvantage can be avoided by multiplying by two the value Δ A for n=1, by multiplying by 4 the value Δ A for n=2, and so on. This can be done by programme by the processing and calculating means, that is to say, the central unit connected to the virtual keyboard memory.

Figure 2:
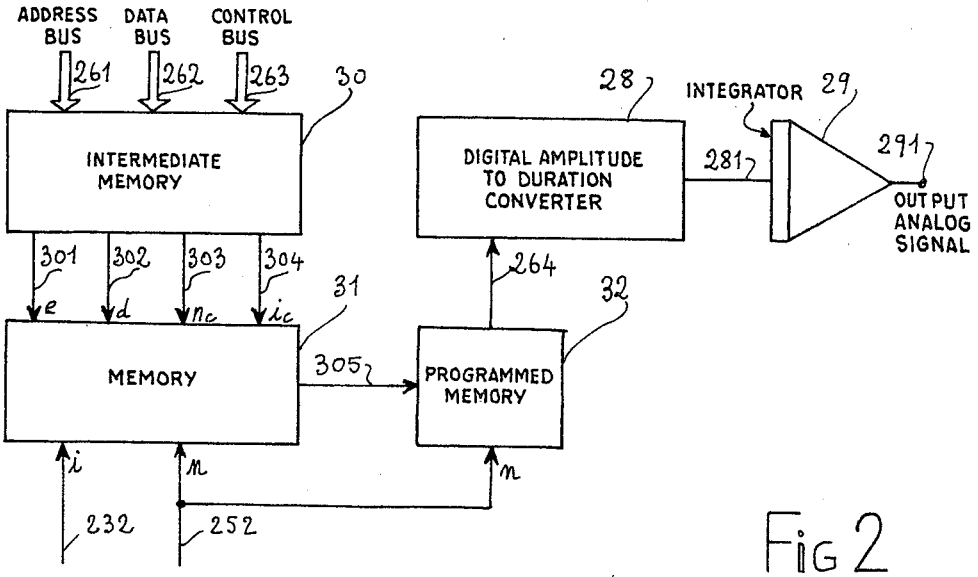
FIG. 2 illustrates a detail and a particular form of the "virtual keyboard" memory.

This disadvantage can also be avoided by using the constructional variant of the synthesizer as illustrated in FIG. 2. This variant makes it possible to place values Δ A in the virtual keyboard 26 without taking account of the aforesaid disadvantage. In accordance with this variant, an intermediate memory 32, addressed by the value of n, performs by transcoding the multiplication of the content Δ A read in the virtual keyboard memory at the address (i, n) by $2^n$.

In FIG. 2, the virtual keyboard 26 is replaced by an assembly comprising an interface circuit 30 and a memory 31. As has already been stated, the interface 30 makes it possible to couple the synthesizer to the buses of a microcalculator of the microprocessor type. The interface 30 is connected to the microprocessor by the address bus 261, the data bus 262 and the control bus (read, write) 263. It addresses a location of the memory 31 through the links 304 (ic) and 303 (nc) for writing data (d) or reading them therein by way of a link 302. The write or read order (e) is transmitted through the link 301. The addressing of the memory 31 also takes place by way of the links 232 (i) and 252 (n) within the synthesizer. A value Δ A (i,n) which is read is transmitted to a program memory 32 which performs, on receiving the value of n (link 252), the multiplication of Δ A (i,n) by $2^{n-k}$, k being an integer which depends upon the precision with which the amplitude must be defined.

Instead of performing a multiplication by $2^{n-k}$, it is equally possible to effect a transcoding Δ A=f (d,n), n being the octave number and d being the data item read in the memory, which represents the amplitude, either in linear representation or in logarithmic representation (decibels). This multiplication is therefore effected by transcoding. The value obtained is transmitted to the converter 28–29 through the link 264.

Figure 3:
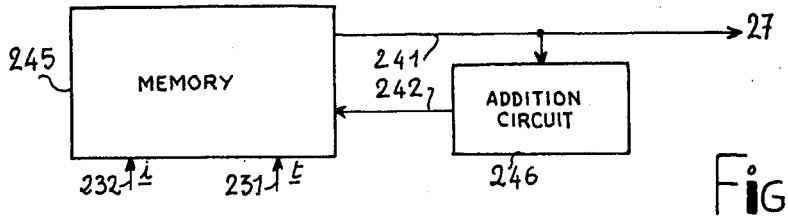
FIG. 3 is a phase calculation circuit.

FIG. 3 illustrates an example of the construction of the phase calculating circuit 24. It comprises a memory 245 which receives as address the note number i (through the link 232). There is here concerned, for example, a 12-octet memory. The data supplied by this memory along a link 241 are the phase values ω it. An addition circuit 246 adds one unit to the value supplied by the memory. This value, increased by 1, is written into the memory 245, through the link 242, on reception of the pulse t (through the link 231).

Figure 4:
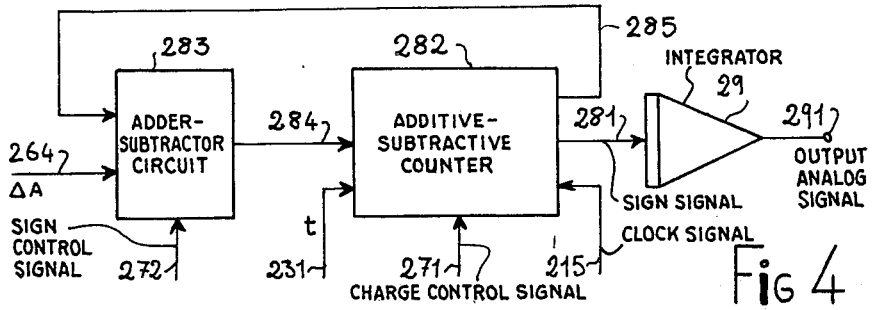
FIG. 4 illustrates an example of a digital-analog converter.

FIG. 4 illustrates an example of the construction of the digital-analog conversion means. This example involves a minimum of analog components.

As previously indicated, these means first comprise a digital-amplitude to duration converter and thereafter a duration-voltage or duration-current converter formed simply of an integrator 29 having a predetermined time constant, which supplies the analog signals at the terminal 291.

The conversion of a digital signal into a proportional duration involves the use of an up-down counter 282 which receives through the link 215 a clock signal provided by the clock 21 (FIG. 1). This up-down counter counts upwards when its content available at a connection 285 is negative, and counts downwards when its content is positive or zero. An adder-subtractor circuit 283 has its output connected to the charging input of the up-down counter 282. It receives the content of the up-down counter through 285 and the value Δ A through the link 264. The sign control signal transmitted through 272 positions the circuit 283 as an adder or as a subtractor. It adds or subtracts the value Δ A to or from the content of the up-down counter in accordance with the value of the sign. The up-down counter 282 is charged by the output of the circuit 283 when the charge control signal, transmitted through 271, is active. The sign of the content of the up-down counter 282 is then transmitted through a link 281 to the integrator 29, which supplies the final complex analog signal at 291.

This sign is represented by a binary signal, the high state of which represents the positive sign, for example, and the low state the negative sign (as for the control signal 272). The pulses t transmitted through 231 serve where necessary to validate the charge control (271).

When a positive value is charged into the up-down counter, the latter counts downwards in step with the clock pulses until its content becomes negative (−1). It then counts upwards and the output sign changes.

However, at each clock pulse, the condition which positions the circuit 282 as an up-counter or as a down-counter changes, at the same time as the sign.

During the period when the sign is constant, the integrator supplies an increasing or decreasing output voltage depending upon the state of the sign. The duration of this period is proportional to the value charged into the up-down counter. At the end of this period, the sign supplied to the integrator changes of state at the clock frequency, and the output of the integrator therefore remains constant. Of course, the time constant of the integrator is made sufficient to obtain this result.

The operation of the conversion means is illustrated by FIG. 5, which shows the form of the signals at different points of the synthesizer.

The signal A represents the output of the chromatic generator for the note i under consideration.

The signal B represents the pulses t produced at each transition of the signal A by the transition detector 23.

The signal C is in fact a series of numbers which represent the state of the phase calculating circuit 24, incremented by one unit at each pulse t.

The signal D represents the charge control signal applied through 271 to the converter 282.

The signal E represents the sign control signal applied through 272 to the adder-subtractor 283. The signals D and E are deduced from the value of C by transcoding.

The signal F represents the output signal of the up-down counter 282. It will be observed that, after each charging of the circuit 282, the sign F is the same as the sign E during a period proportional to the charged value, and then the sign oscillates at the frequency of the clock until the next charging.

The signal G represents the output analog signal of the integrator 29 at 291. To each constant period of the sign of F there corresponds a rising or descending ramp of the signal G, depending upon the sign of F. There correspond to the periods of oscillation of the sign of F flat portions for G.

Since the ramps are linear, the difference between the amplitudes of two consecutive flat portions is proportional to Δ A, the value charged into the up-down counter 282.

Figure 6:
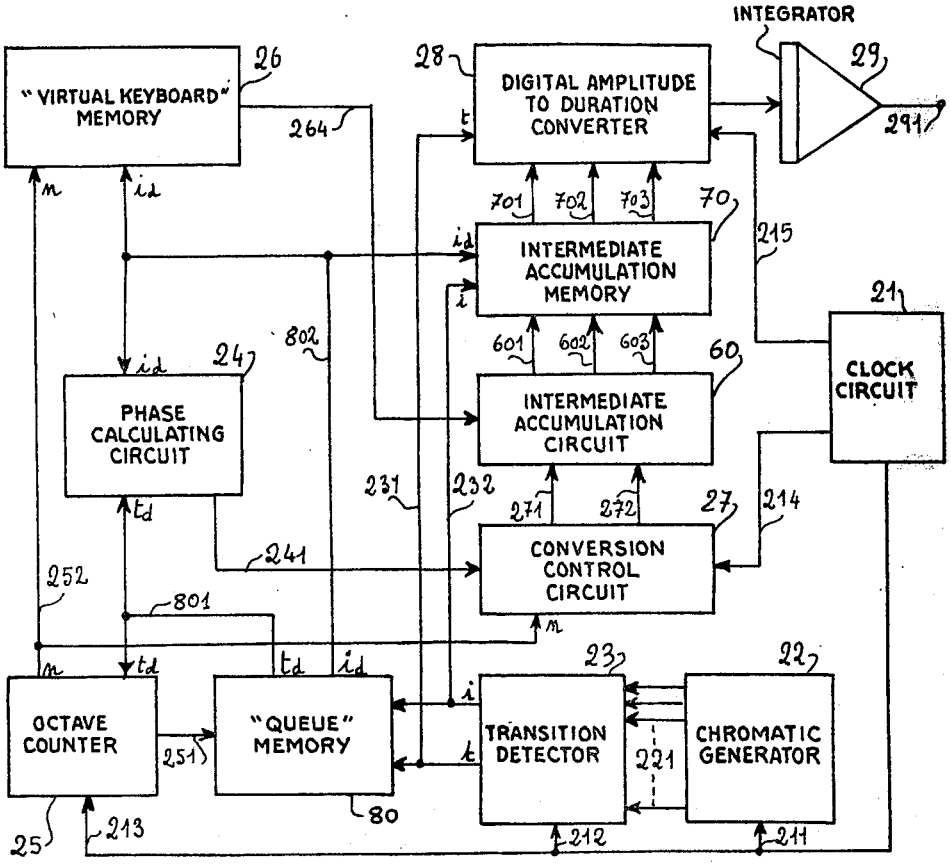
FIG. 6 illustrates an example of an improved construction of the synthesizer.

FIG. 6 illustrates a variant of the invention by means of which it is possible to reduce notably the frequency of the clock 21. This variant makes it possible notably to obtain correct operation for clock frequencies lower than 1 MHz. This is important and renders possible integration of the circuits of the synthesizer in one or more integrated circuit chips, for example by MOS technology.

In this figure, the circuits and connections which are identical to circuits and connections in FIG. 1 are again denoted by the same references.

The "virtual keyboard" memory 26 is assumed to be of the type illustrated in FIG. 2. It contains the amplitude of the signals to be generated, but supplies, by reason of an appropriate transcoding, the increment of amplitude Δ A. An interface device, forming part of the clock 26, enables the user and the control circuits of the synthesizer to read the content of the memory.

The digital amplitude to duration converter 28–29 also remains the same as in FIG. 1, but it no longer receives the signal Δ A directly from the virtual keyboard 26.

The clock circuits 21, the means for the production of reference pulses comprising the chromatic generator 22 and the transition detector 23 are also unchanged.

With regard to the means for controlling the reading of the virtual keyboard and the conversion, the octave counter 25, the phase calculating circuit 24 and the conversion control circuit 27 remain identical in their structure and their operation.

The improvements introduced in this figure are relative to the presence of a so-called "queue" memory 80 intercalated between the transition detector 23 and the octave counter 25. This memory receives the signals i and t from the detector 23 and supplies new signals id and td which are in turn applied to the reading and conversion control means.

An "intermediate accumulation" circuit 60, composed of an adder-subtractor for example, and an "intermediate accumulation" memory 70 are interposed in series between the conversion control circuit 27 and the converter 28. The values Δ A are applied to the circuit 60 instead of the converter 28, where they are accumulated with preceding values as a function of the state of the sign signals (272) and the charging signals (271) and placed in memory (27) temporarily at an address defined by id.

The link 231 transmits the signal t to the queue 80 and to the converter 28. The link 232 transmits the signal i to the queue 80 and to the accumulation memory 70 for controlling the reading and the transmission towards the converter 28 of the charge control signals (link 701), the sign signals (link 702) and the accumulated charge value signals (link 703).

The link 264 transmits the value Δ A read in the virtual keyboard memory 26 to the intermediate accumulation circuit 60. The latter transmits its content to the accumulation memory 70 through the links 601 (charge control), 602 (charge sign) and 603 (charge value).

The value id (link 802) emanating from the queue memory 80 serves to address the virtual keyboard 26, the phase counter 24 and the accumulation memory 70 (at writing). The beginning-of-cycle control td (link 801) is applied as in the case of FIG. 1 to the octave counter 25 and to the phase counter 24.

The queue 80 is of the "first in, first out" type (FIFO). Many circuits are available for performing this function, such as the circuit "3341" manufactured by the company Fairchild.

The beginning-of-cycle signal t (231), supplied by the transition detector 23, makes it possible to charge the queue with the corresponding number i (232) of the note.

The transition detector 23 then no longer requires an end-of-cycle signal (251) for continuing to detect the transitions. It no longer stops and it transmits to 80 the pairs (t,i) as they arrive.

The queue 80 supplies a beginning-of-cycle signal td delayed in relation to t, as well as the value of the corresponding note id, after reception of an end-of-cycle signal supplied by the octave counter 25 (link 251).

The octave counter 25, the phase calculating circuit 24 and the conversion control circuit 27 then operate as in the case of FIG. 1, but the circuit 27 supplies its control signals (271, 272) this time to the intermediate accumulation circuit 60. The latter has the function of accumulating, for a note of given name id, all the variations of amplitude Δ A and of sign transmitted by 272 relative to the various octaves of this note.

The result of this accumulation is an amplitude variation (603) and a sign (602) which represent the contribution of the notes of name id of the virtual keyboard to the final polyphonic effect. This result is stored in a memory 70 which receives id as writing address and i as reading address (i=id, but at different instants).

The content of the memory 70 is utilised at the succeeding transition (as compared with that which has given rise to it) detected by the detector 23. The corresponding signals then activate the conversion means 28–29 which receive from the memory 70 the amplitude variation (703), the sign (702) and the charge control signal (701). The whole is synchronised by the signal t, that is to say, the transition applied to the conversion means through 231.

This enables a note, at the corresponding amplitude variation, to be reflected on the final analog signal (at 291) in phase with the corresponding transition of the chromatic generator 22. This avoids the use of a high-frequency clock 21.

In the construction of the circuits illustrated in FIG. 6, as in FIG. 1, use is made of commercially obtainable components which are at present in use. Many constructional variants are possible. For example, there may be provided means for re-reading the memories of the virtual keyboard 26 by the user, by way of the buses 261,262 and 263 and interface circuits (30, FIG. 2).

In order to reduce the frequency of the clock circuit 21 necessary for the control and the synchronisation of the synthesizer, variants of the end-of-cycle signal transmitted through 251 are possible. It is in fact unnecessary to generate at the output 291 a complex signal comprising all the notes of the virtual keyboard when the amplitudes of a large number of them are zero. Consequently, the end-of-cycle signal can be generated before the end of the excursion of the octaves if it is known that no upper octave will be produced. For example, the end-of-cycle signal can be supplied (as well as by the counter 25) by an additional binary element in each memory location of the virtual keyboard 26. This binary element can be positioned either by the user by way of the writing devices and the buses, or directly within the synthesizer, when the data encountered are all zero up to the last position of the virtual keyboard.

Further modified embodiments of the present invention may be envisaged at the level of the "virtual keyboard" memory.

Instead of a memory location for each signal to be produced, it is possible to provide in each memory location data concerning a group of notes. This makes it possible to increase considerably the number of signals to be produced.

The organisation of the data in the memory can also be envisaged in various ways. Instead of the increasing order of the addresses being allocated in accordance with the increasing order of the frequencies of the signals to be produced, it is possible for one group of successive addresses to be successively allotted to the fundamental frequency and to the various harmonics of a common note, and then the other groups of addresses to the other notes. It is furthermore possible to divide each scale, not into 12 semitones, but into 24 quartertones, or even with a finer division, whereby it is possible to obtain the glide effect by address displacement.

Figure 7:
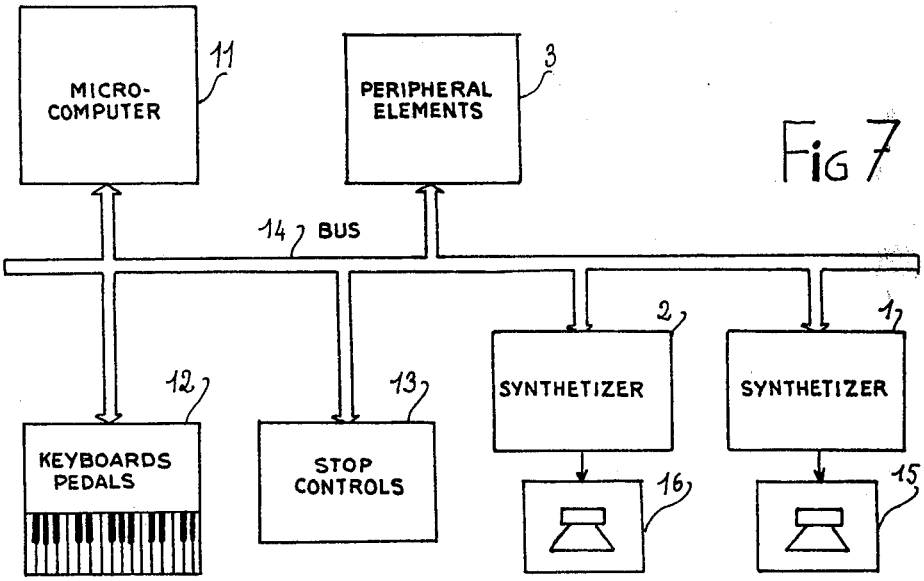
FIG. 7 illustrates an example of a musical instrument comprising one or more synthesizers according to the invention.

FIG. 7 illustrates an example of the application of the invention to a musical instrument.

Two synthesizers 1 and 2 according to the invention are coupled to a common collecting bus 14 on the one hand and to sound-diffusing amplifiers 15 and 16. Of course, any number of synthesizers can be coupled to the bus, depending upon the result desired by the user.

The user plays the instrument by actuating one or more manuals 12 (keyboards, pedals) and a set of stop controls 13. The state of the keyboards and stops and the control of the synthesizers is read by a micro-computer 11 organised around a micro-processor, memories, a clock and control circuits for the bus 14.

Other peripheral elements 3 may be coupled to the bus 14, for example for recording and reading the data and the instructions on a magnetic tape or a punched tape, or an input-output terminal may be employed, or again the instrument may be connected to another data handling system which may be more powerful and more complex, which is useful for the setting-up of the instrument.

Thus, the transformation of the data relative to the real keyboards and stops and to data relative to the virtual keyboards is a programmed operation, that is to say, different instruments can be produced by changing the programming, which does not affect the equipment. More particularly, the programs may be stored in read-only memories and played by means of external members (3).

Special effects such as percussion, sustaining, arpeggios, automatic chords, etc., can be produced by programming.

The present invention makes it possible to produce with commercially obtainable components, in a relatively reduced number, instruments of all kinds having richness of tones which has not hitherto been equalled. Most of the circuits lend themselves to integration on a large scale, so that the cost of the components and manufacture can be considerably reduced. The programming of an instrument can be readily modified or amplified by simple charge or addition of programmed read-only memories or by data reading.

What I claim is:

1. A polyphonic synthesizer for producing a plurality of periodic signals of predetermined frequencies and of respective amplitudes independently controlled by external means comprising:

a set of digital memories at least equal in number to the periodic signals to be simultaneously produced by the synthesizer; said set of memories including first address, data and control inputs for storing amplitude digital data in the memories from said external means and second address inputs and a data output;

phase calculating circuit means having an address input, a control input for controlling the incrementation of a phase digital value and an output for delivering said incremented phase digital value;

digital-analog converting means having a digital input connected to the data output of the set of memories, an analog output and control inputs;

transcoding means connected between the output of the phase calculating circuit and the control inputs of the digital-analog converting means;

means for producing a set of pulsing signals of different frequencies distributed in a musical range; and control means for producing sequentially, in response to each pulsed signal, address signals corresponding to said pulsed signal for the second address inputs of said memories and the address input of said phase calculating circuits, and a control signal for the control input of said phase calcualting means.

2. A polyphonic synthesizer for producing a plurality of periodic signals of predetermined frequencies and of independently controlled amplitudes, comprising:

a set of digital memories at least equal in number to the periodic signals to be simultaneously produced, the address of each memory corresponding to the frequency of a periodic signal to be produced and the content of each memory corresponding to at least the desired amplitude of the corresponding periodic signal;

digital-analog conversion means for producing analog voltage or current steps whose amplitude is proportional to a corresponding data item read in a memory, and in response to control signals;

means for producing a set of pulsed signals of which the repetition frequencies are distributed over a predetermined musical range; and control means for producing, from each pulsed signal, control signals for the reading and transfer of the data from the memories to the conversion means and for producing conversion control signals for the conversion means; said control means including:

transition-detecting means for supplying at each pulse signal a beginning-of-cycle pulse and an addressing data item(i) relative to the frequency of the pulsed signal which has produced the said pulse, an octave counter for receiving the beginning-of-cycle pulse and for successively supplying addressing data (n) relative to the octaves of the note (i), a phase amplitude calculating circuit addressed by the data item (i) and incremented by the beginning-of-cycle pulse, for supplying a phase amplitude data item, a conversion control circuit for receiving the addressing data (n) and the phase amplitude data item and supplying sign and charging control signals for the conversion means; and read control means for applying the data (i,n) for the addressing of the set of memories and for transferring the data item from the memories to the conversion means.

3. A polyphonic synthesizer for producing a plurality of periodic signals of predetermined frequencies and of independently controlled amplitudes, comprising:

a set of digital memories at least equal in number to the periodic signals to be simultaneously produced, the address of each memory, corresponding to the frequency of a periodic signal and the content of each memory corresponding to at least the desired amplitude of the corresponding periodic signal;

digital-analog conversion means for producing analog voltage or current steps whose amplitude is proportional to a corresponding data item read in a memory, and in response to control signals;

means for producing a set of pulsed signals of which the repetition frequencies are distributed over a predetermined musical range; and control means for producing, from each pulsed signal, control signals for the reading and transfer of the data from the memories to the conversion means and for producing conversion control signals for the conversion means; said control means includes:

transition-detecting means for supplying at each pulsed signal a synchronisation pulse (t) and an addressing data item (i) relative to the frequency of the pulsed signal which has produced the said pulse;

a queue memory for receiving the pair of signals (i,t) when a transition occurs and for supplying asynchronously a beginning-of-cycle pulse (td) and an addressing data item (id) identical to the data (i);

an octave counter for receiving the beginning-of-cycle pulse (td) and for successively supplying addressing data (n) relative to the octaves of the note;

a phase amplitude calculating circuit addressed by the data item (id) and incremented by the beginning-of-pulse (td), for supplying a phase amplitude data item;

a conversion control circuit for receiving the addressing data (n) and the phase amplitude data item and supplying sign and charging control signals;

an accumulator circuit for adding to its content the data item read in the set of memories and a memory circuit as a buffer between the accumulator circuit and the conversion means, and read control means for transferring the data item and the sign and charging control signals from the buffer memory circuit to the conversion means in synchronism with signals (i,t).

4. A synthesizer according to claim 1, wherein the digital analog converting means comprises, an up and down counter having a data input, a data output, an up-down control input connected to the data output in order to place the counter in the up-counting operation when the output data is negative and in the down-counting operation when the output data is positive, and a load control input connected to the transcoding means;

an adder-subtractor circuit having an add-subtract control input connected to the transcoding means, a first data input connected to the data output of the set of memories, a second data input connected to the data output of the counter and a data output connected to the data input of the counter; and an analog integrator circuit having an analog input connected to the up-down control input of the counter and an analog output for delivering the output signals of the synthesizer.

5. A polyphonic synthesizer of periodic signals comprising a multiplicity of pulse signal generators, characterized by the fact that it comprises in addition;

a set of digital memories equal in number at least to the number of periodic signals to be produced simultaneously, said set of memories comprising means for the external addressing of each memory to record digital amplitude data and means for the internal addressing to feed amplitude data to an output;

a set of instantaneous phase counters equal in number to the generators and comprising means to address each counter, means for incrementing the content of the selected counter and an output to deliver an instantaneous digital phase value;

a digital-analog converter with a digital input connected to the output of the set of memories, an analog output and a command input;

a transcoding circuit connected between the output of the set of phase counters and the command input of the converter; and command devices connected to the generators, for sequential generation, approximately synchronised with each transition of the generator signals, on the one hand, of internal command addressing signals (i,n) of at least one digital memory and of one phase counter, and on the other hand, of a command signal for phase incrementation and for analog conversion of the digital data read in the memory.

6. A synthesizer in accordance with claim 5, characterized in that the set of memories comprises in addition transcoding devices receiving at an input, on the one hand, an internal addressing signal (n) from the memories and, on the other hand, the content of the addressed memory, to deliver at the output new amplitude data.

7. A synthesizer in accordance with claims 5 or 6, characterized in that the digital-analog converter comprises, in series, a first amplitude-duration converter and a second duration-voltage converter, said first converter comprising:

an adder-subtracter having a digital input, an input for counting direction command connected so as to add when the adder content is negative, and to subtract when the content is positive, an output delivering a signal that is representative of the sign of the adder-subtracter content, and a loading command input;

an adder-subtracter curcuit having an input for addition or subtraction command, two digital inputs designed to receive, respectively, the amplitude data delivered by the set of memories and the content of the adder-subtracter and an output connected to the input of the adder-subtracter; and said second converter comprising an analog integrating circuit whose input is connected to the output of the adder-subtracter, and an analog output.

8. A synthesizer in accordance with one of claims 5 or 6, characterized in that the command devices comprise a transition detector connected to the generators and delivering a command pulse (t) and a first internal addressing datum (i), and an octave counter having a command input to receive the pulse (t) and an output to deliver a second internal addressing datum (n).

9. A polyphonic music instrument comprising a polyphonic synthesizer in accordance with any one of claims 5 or 6 characterized in that the external addressing devices of the set of memories comprise a microcomputer with microprocessor, and a set of connection buses.

10. A synthesizer according to claim 1, wherein the set of memories comprises a number of read and write memory elements, means for addressing, writing and reading any memory element from a data processing system outside the synthesizer, and internal means for the addressing and reading only of any memory element from the control means of the synthesizer.

11. A synthesizer according to claim 10, wherein the internal addressing means comprise means for decoding and addressing from two signals, of which one (i) is relative to the name of a musical note, regardless of the octave in which it is situated, and the other (n) is relative to the octave to be produced.

12. A synthesizer according to claim 11, wherein the set of memories further comprises transcoding means for receiving the value (n) applied for the addressing of each memory and the data item read in said memory and for supplying a new data item as a function of the preceding one and of n.

13. A synthesizer according to claim 1 wherein the digital-analog conversion means comprise means for the conversion of a digital data item into a bipolar signal, of which the state is determined by a sign control signal and the duration of the state of which is proportional to the digital data applied to it, and analog integration means for converting the bipolar signal into a voltage or current step whose amplitude is proportional to the said digital data item.

14. A synthesizer according to claim 13, wherein the means for the conversion of a digital data item into a duration comprise an up-down counter which is so connected as to count upwards under the control of clock signals when its content is negative and to count downwards when its content is positive, the up-down counter comprising an output which supplies a bipolar signal representing the sign of its content, a charging input and a charging control input and an adder-subtractor circuit having an addition or subtraction control input, two inputs intended to receive respectively the data item to be converted and the content of the up-down counter and an output connected to the charging input of the up-down counter.

* * * * *